US008919830B2

(12) United States Patent
Norton et al.

(10) Patent No.: US 8,919,830 B2
(45) Date of Patent: Dec. 30, 2014

(54) BARRIER ISOLATOR PORT ASSEMBLY

(75) Inventors: Paul H. Norton, Trumbauersville, PA (US); Edward Vander Bush, Downingtown, PA (US); W. Edward Hill, Morgantown, PA (US); Robert Nase, Reading, PA (US)

(73) Assignee: West Pharmaceutical Services, Inc., Exton, PA (US)

( * ) Notice: Subject to any disclaimer, the term of this patent is extended or adjusted under 35 U.S.C. 154(b) by 365 days.

(21) Appl. No.: 13/127,294

(22) PCT Filed: Nov. 5, 2009

(86) PCT No.: PCT/US2009/063328

§ 371 (c)(1),
(2), (4) Date: May 3, 2011

(87) PCT Pub. No.: WO2010/054031

PCT Pub. Date: May 14, 2010

(65) Prior Publication Data

US 2011/0209410 A1 Sep. 1, 2011

Related U.S. Application Data

(60) Provisional application No. 61/111,516, filed on Nov. 5, 2008.

(51) Int. Cl.

| | |
|---|---|
| ***B65D 45/30*** | (2006.01) |
| ***B65D 45/32*** | (2006.01) |
| ***G21F 7/005*** | (2006.01) |
| ***B01L 1/02*** | (2006.01) |

(52) U.S. Cl.
CPC .. *G21F 7/005* (2013.01); *B01L 1/02* (2013.01)
USPC ..... 292/256.6; 422/297; 414/217; 292/143

(58) Field of Classification Search
USPC ..... 292/256.6, 257, DIG. 33, 7, 34, 36, 46, 292/71, 65, 140, 159, 197, 215, DIG. 7
See application file for complete search history.

(56) References Cited

U.S. PATENT DOCUMENTS 2,461,284 A * 2/1949 Reinhold ..... 292/143
4,640,686 A 2/1987 Dalling et al.

(Continued)

FOREIGN PATENT DOCUMENTS

EP 586307 A1 3/1994
FR 2573909 A1 5/1986

(Continued)

OTHER PUBLICATIONS

Int'l Search Report and Written Opinion Issued Jul. 23, 2009 in Int'l Application No. PCT/US2009/047483.

(Continued)

*Primary Examiner* — Kristina Fulton
*Assistant Examiner* — Thomas Neubauer
(74) *Attorney, Agent, or Firm* — Panitch Schwarze Belisario & Nadel LLP

(57) ABSTRACT

A barrier isolator port assembly for connecting to a conventional docking port of an isolated enclosure is provided. The port assembly includes an annular body, a door assembly and a lock. The annular body is configured to engage a docking port of the isolated enclosure. The port assembly also includes a door assembly mountable within the annular body and a lock operatively connected to the annular body. The lock includes a lever and a pin. The lever is pivotably connected to the annular body about a pivoting member and configured to pivot about the pivoting member to removably insert the pin into the recess of the door assembly.

20 Claims, 14 Drawing Sheets

(56) References Cited

U.S. PATENT DOCUMENTS

| | | | | |
|---|---|---|---|---|
| 4,643,328 | A | 2/1987 | Lorenzelli et al. | |
| 4,678,620 | A * | 7/1987 | Marshall et al. | 376/203 |
| 4,911,485 | A * | 3/1990 | Wasilewski | 292/139 |
| 5,127,535 | A * | 7/1992 | Shinno | 220/323 |
| 5,421,626 | A * | 6/1995 | Glachet | 292/256.5 |
| 5,451,210 | A | 9/1995 | Kramer et al. | |
| 5,715,659 | A * | 2/1998 | Norton | 53/492 |
| 5,843,036 | A | 12/1998 | Olive et al. | |
| 5,853,207 | A * | 12/1998 | Saint Martin et al. | 292/256.6 |
| 5,870,886 | A * | 2/1999 | Norton | 53/492 |
| 6,210,369 | B1 | 4/2001 | Wilmot et al. | |
| 6,428,528 | B2 | 8/2002 | Sadowski et al. | |
| 6,537,509 | B2 * | 3/2003 | Saint-Martin et al. | 422/297 |
| 6,565,553 | B2 | 5/2003 | Sadowski et al. | |
| 6,591,662 | B1 | 7/2003 | Grimard et al. | |
| 6,986,760 | B2 | 1/2006 | Giambattista et al. | |
| 7,011,649 | B2 | 3/2006 | De La Serna et al. | |
| 7,066,907 | B2 | 6/2006 | Crossman et al. | |
| 7,297,136 | B2 | 11/2007 | Wyrick | |
| 7,314,464 | B2 | 1/2008 | Giambattista et al. | |
| 2004/0039336 | A1 | 2/2004 | Amark et al. | |
| 2004/0193110 | A1 | 9/2004 | Giambattista et al. | |
| 2005/0113750 | A1 | 5/2005 | Targell | |
| 2005/0161957 | A1 | 7/2005 | McGuire | |
| 2005/0283115 | A1 | 12/2005 | Giambattista et al. | |
| 2005/0288633 | A1 | 12/2005 | Jeffrey | |
| 2006/0270986 | A1 | 11/2006 | Hommann et al. | |
| 2007/0129686 | A1 | 6/2007 | Daily et al. | |
| 2007/0135767 | A1 | 6/2007 | Gillespie et al. | |
| 2007/0265568 | A1 | 11/2007 | Tsals et al. | |
| 2007/0293819 | A1 | 12/2007 | Giambattista et al. | |
| 2008/0132838 | A1 | 6/2008 | Wyrick | |
| 2008/0228143 | A1 | 9/2008 | Stamp | |
| 2009/0005737 | A1 | 1/2009 | Chun | |
| 2009/0054849 | A1 | 2/2009 | Burnell et al. | |
| 2009/0288346 | A1 * | 11/2009 | Esser | 49/373 |

FOREIGN PATENT DOCUMENTS

| | | | |
|---|---|---|---|
| FR | 2613526 | A1 | 10/1988 |
| FR | 2787190 | A1 | 6/2000 |
| GB | 2030503 | A | 4/1980 |
| GB | 1018655 | | 1/1996 |
| GB | 2293787 | A | 4/1996 |

OTHER PUBLICATIONS

Int'l Search Report and Written Opinion issued Mar. 15, 2010 in Int'l Application No. PCT/US2009/063328.

* cited by examiner

BARRIER ISOLATOR PORT ASSEMBLY

CROSS-REFERENCE TO RELATED APPLICATIONS

This application is a section 371 of International Application No. PCT/US2009/063328, filed Nov. 5, 2009, which was published in the English language on May 14, 2010 under International Publication No. WO 2010/054031 A1 and which claims the benefit of priority to U.S. Provisional Application No. 61/111,516, filed Nov. 5, 2008, the entire disclosures of which are incorporated herein by reference.

BACKGROUND OF THE INVENTION

The present invention relates to a port assembly. In particular, the present invention relates to a barrier isolator port assembly that provides a means for transferring material between two enclosures isolated from an external environment.

A conventional manner in which transfer between two isolated enclosures is accomplished is shown in FIG. 1. In this example, the contents of a first isolated enclosure 1010 are transferred to a second isolated enclosure 1012 via a docking assembly. The docking assembly includes a docking port 1014 configured on the second isolated enclosure 1012 and a port assembly 1016 that is attached to a container, such as a bag 1018. As used in the relevant industries, the docking port 1014 is commonly referred to as the "alpha" side while the port assembly 1016 is referred to as the "beta" side. To effectuate a transfer of the contents of the first isolated enclosure 1010 to the second isolated enclosure 1012, the port assembly 1016 is docked with the docking port 1014, as shown in FIG. 1, step 2. When docked, the docking port 1014 and port assembly 1016 have respective doors that are connected to form a hermetically sealed enclosure enclosing their respective outside surfaces such that the outside surfaces can be isolated from the internal environment of the isolated enclosures 1010, 1012. Thereafter, the respective doors of the docking assembly are removed or at least moved out of the way and a passageway is opened and the contents of the first isolated enclosure 1010 can pass through the docking assembly to the interior of the second isolated enclosure 1012, as shown in FIG. 1, step 3.

Critical to the success of such transfer means is the docking assembly itself, i.e., the port assembly 1016 and docking port 1014. U.S. Pat. No. 5,853,207 ('207 patent) discloses a conventional joining and sealing device (i.e., a port assembly) for use with such docking assemblies. However, the device of the '207 patent has limited utility in that it is a single use device that cannot be used more than once to transfer material between enclosures. As such, there is a need for a joining and sealing device that can provide a means for transferring or manipulating material between two enclosures isolated from an external environment that can be used multiple times while being cost effective and economical.

BRIEF SUMMARY OF THE INVENTION

In accordance with the present invention, the problem of joining and sealing together two enclosures multiple times is solved by a barrier isolator port assembly having a door lock capable of being locked and unlocked multiple times. In this way, the transfer or manipulation of materials between two enclosures isolated from an external environment can be repeatedly accomplished.

In an embodiment, the present invention provides a barrier isolator port assembly comprising an annular body, a door assembly and a lock. The annular body is configured to engage a docking port of an isolated enclosure and includes a thru-hole. The door assembly is mountable within the annular body and movable between an open position to access the isolated enclosure and a closed position preventing access to the isolated enclosure. The door assembly also includes a periphery having a recess alignable with the thru-hole of the annular body when the door assembly is in the closed position. The lock is operatively connected to the annular body and includes a lever and a pin. The lever includes first and second ends and is pivotably connected to the annular body about a pivoting member. The pin is connected to the second end of the lever. The lever is pivotable to move between a first position with a portion of the pin within the thru-hole and a second position with the pin removably inserted in the recess of the door assembly.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Reference will now be made in detail to the present embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. Such directional terms used in conjunction with the following description of the drawings should not be construed to limit the scope of the invention in any manner not explicitly set forth. Unless specifically set forth herein, the terms "a", "an" and "the" are not limited to one element but instead should be read as meaning "at least one". The terminology includes the words noted above, derivatives thereof and words of similar import.

In a preferred embodiment, the present invention provides a beta-side barrier isolator port assembly 10 (hereinafter "port assembly"), as shown in FIGS. 4-19. The port assembly 10 can be used, for example, as a port assembly 10 for a container, such as a sterile bag or other isolated enclosure. Other exemplary uses for the port assembly 10, include for example, containers for hazardous or toxic waste materials.

The port assembly 10 is configured to mate with conventional alpha-side docking ports (see e.g., FIGS. 1-3) such that a transfer of material through the docking port is possible. Such transfers can be accomplished e.g., between two isolated enclosures while maintaining the integrity e.g., sterile interiors, of each enclosure. Conventional alpha-side docking ports suitable for use with the port assembly 10 include those manufactured by Sartorius Stedim Biotech of Aubagne, France and as disclosed in U.S. Pat. No. 5,853,207, the disclosure of which is hereby incorporated by reference herein, in its entirety.

Figure 2:
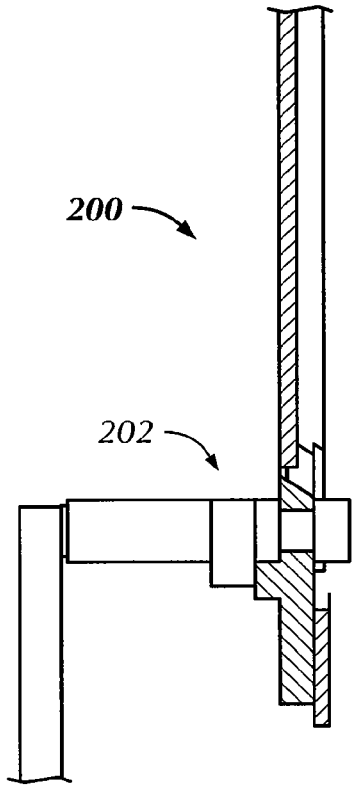
FIG. 2 (Prior Art)
FIG. 2 is a partial, side, cross-sectional, elevational view of a conventional docking port of a docking assembly.
Figure 3:
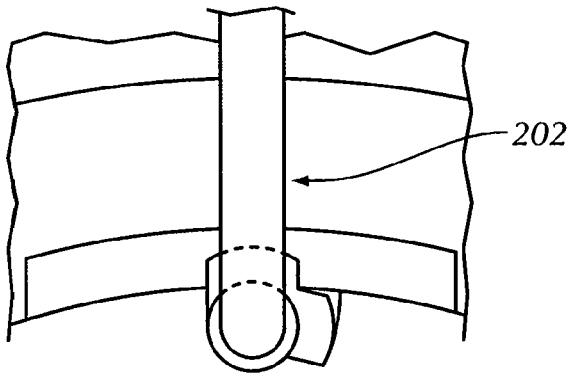
FIG. 3 (Prior Art)
FIG. 3 is a partial, front, elevational view of a cam assembly of the docking port of FIG. 2.
Figure 4:
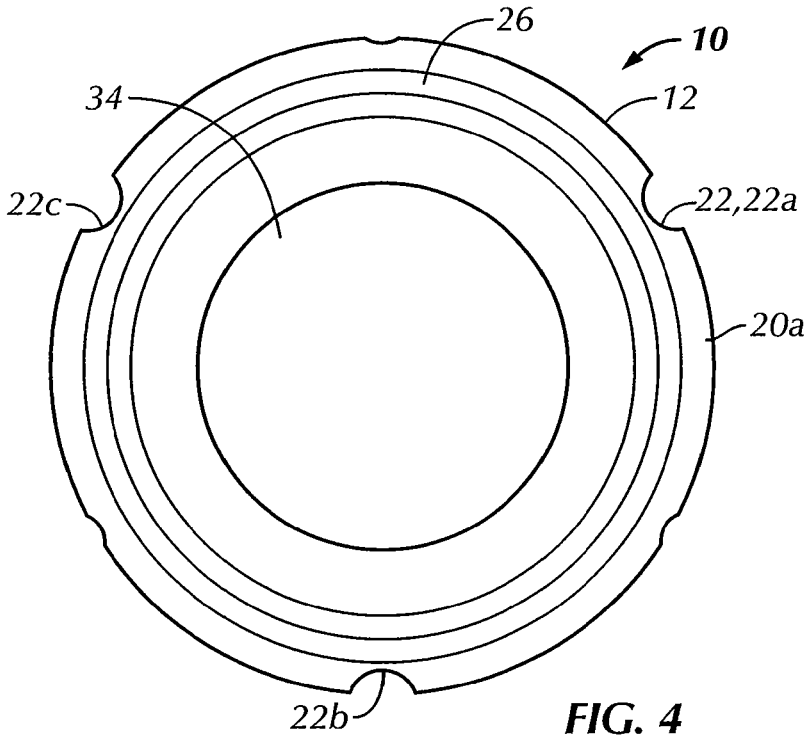
FIG. 4 is a mating side elevational view of a port assembly in accordance with a preferred embodiment of the present invention.
Figure 5:
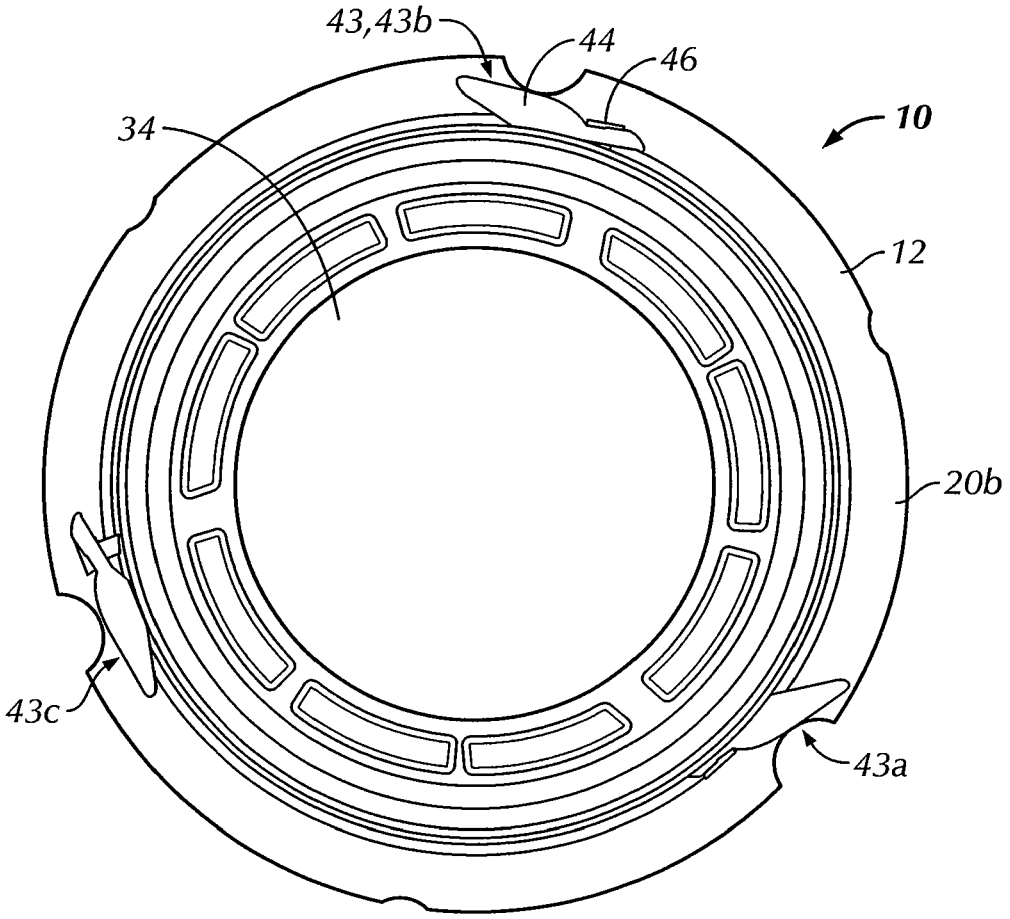
FIG. 5 is a non-mating side elevational view of the port assembly of FIG. 4.
Figure 6:
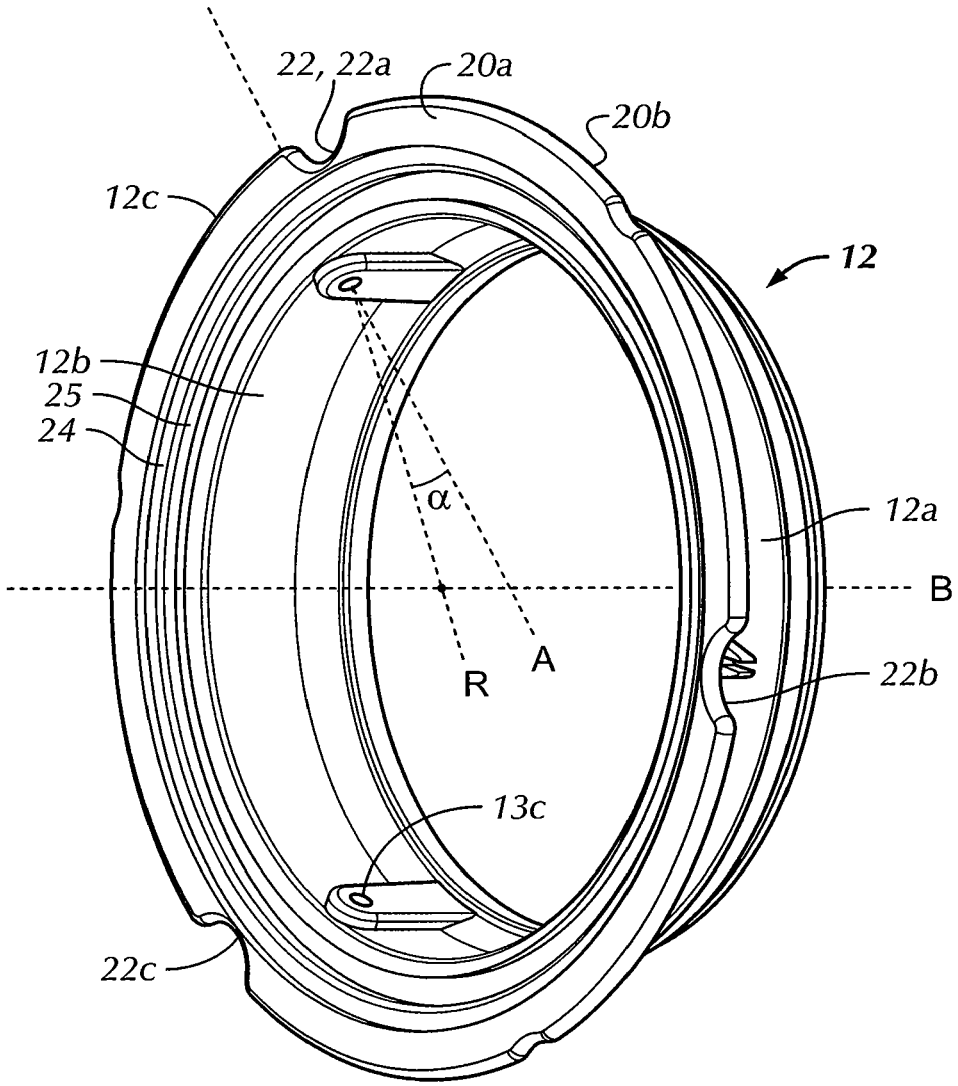
FIG. 6 is a mating side perspective view of an annular body of the port assembly of FIG. 4.

Referring to FIGS. 4 and 5, the port assembly 10 includes an annular body 12, a door assembly 34, and a lock 43. In general, the annular body 12 is configured to engage a docking port 200 (FIGS. 2-3). Referring to FIGS. 2, 3 and 6, the mating-side of the annular body 12 has a generally planar mating-side surface 20*a* that can be sized and shaped to mate with conventional alpha-side docking ports 200. While the port assembly 10 is generally configured as a circular port assembly 10, it can alternatively be configured in any shape, such as a square, rectangular, triangle, oval, or the like suitable for its intended use. Generally, the port assembly 10 is sized to mate with any suitable conventional alpha-side docking port 200.

The side of the port assembly 10 facing the alpha-side docking port, as best shown in FIG. 4, is referred to as the mating side of the port assembly 10. The opposite side, or the side of the port assembly 10 that faces part of the interior of a container 61 (FIG. 20) is referred to as the non-mating side 20*b* of the port assembly 10 (FIG. 5).

Figure 7:
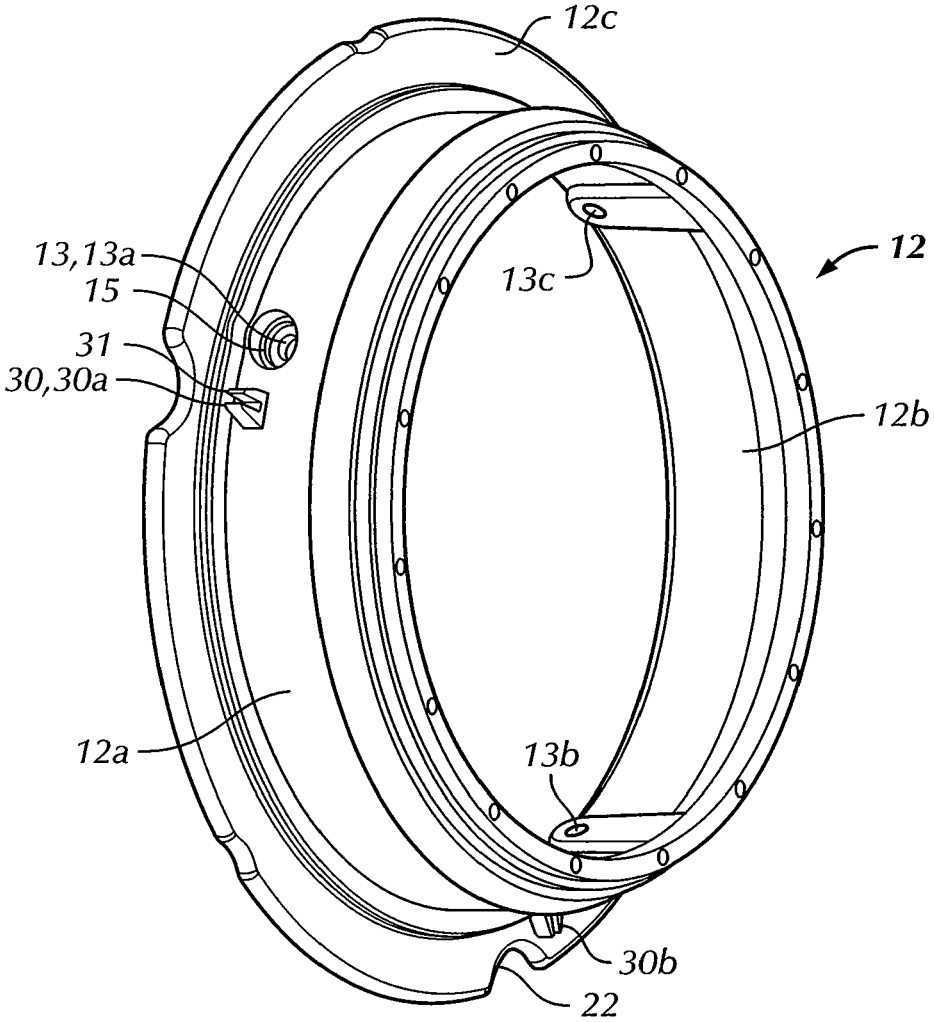
FIG. 7 is non-mating side perspective view of the annular body of FIG. 6.

The body 12 of the port assembly 10 is of an annular configuration and includes at least one radially extending thru-hole 13 that extends from a radial outer surface 12*a* to a radial inner surface 12*b* of the annular body 12 (FIGS. 6 and 7). Preferably, the annular body 12 includes a plurality of thru-holes 13 and more preferably, three thru-holes 13*a-c* that are circumferentially and equidistantly spaced apart. The thru-holes 13 are sized to receive a pin 46, as further discussed in detail below. Each thru-hole 13 is also configured as a cylindrical thru-hole 13 having a double counterbore 15 and a longitudinal axis A that is orthogonal to a longitudinal axis B of the annular body 12. Furthermore, the longitudinal axis A of the thru-hole 13 is preferably at an angle alpha ($\alpha$) relative to a radial direction (axis R) of the annular body 12. The angle $\alpha$ is preferably about 5 to 20 degrees.

Referring to FIG. 6, the annular body 12 also includes a radially outwardly extending flange 12*c* about the mating side of the annular body 12. The radially outwardly extending flange 12*c* is configured to engage the docking port 200. The flange 12*c* includes a mating surface 20*a* and an opposite non-mating surface 20*b*. About the outer periphery of the flange 12*c* is a semi-circular cutout 22. The cutout 22 is sized and configured to receive and align with a cam assembly 202 that is attached to the alpha-side docking port 200. The flange 12*c* can be configured with one or more cutouts 22, but is preferably configured with three circumferentially and equidistantly spaced apart cutouts 22*a-c* that are sized and spaced to match up with three cam assemblies 202 on the conventional alpha-side docking port 200.

Figure 8:
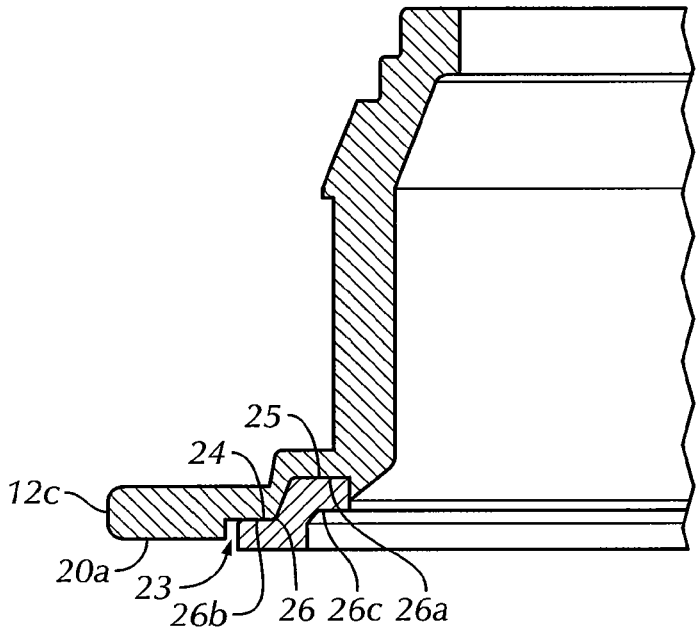
FIG. 8 is an enlarged, partial, cross-sectional, side view of the port assembly of FIG. 4.
Figure 9:
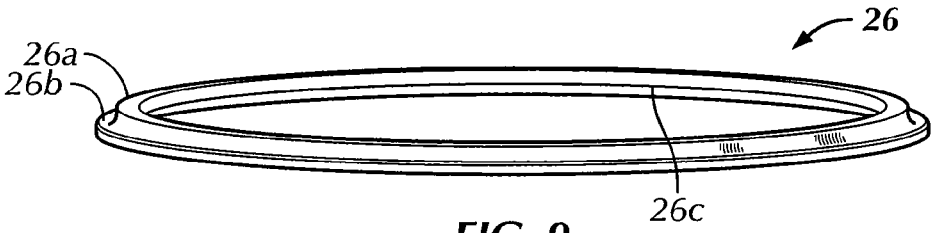
FIG. 9 is a perspective view of a sealing member of the port assembly of FIG. 4.
Figure 10:
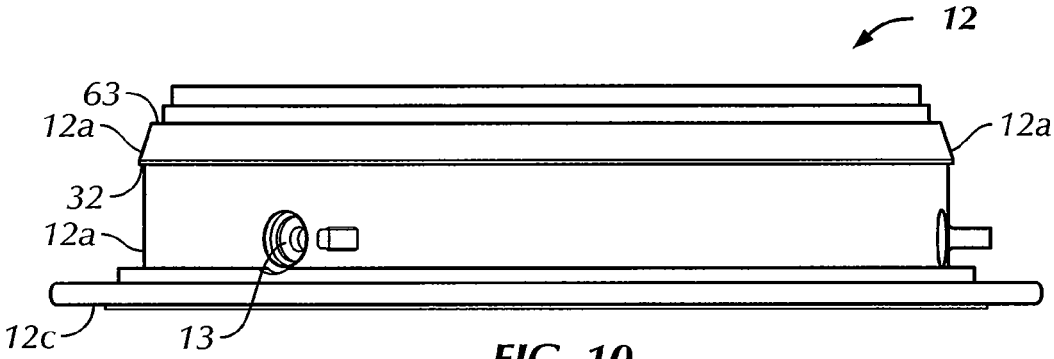
FIG. 10 is a side elevational view of the annular body of FIG. 6.
Figure 11:
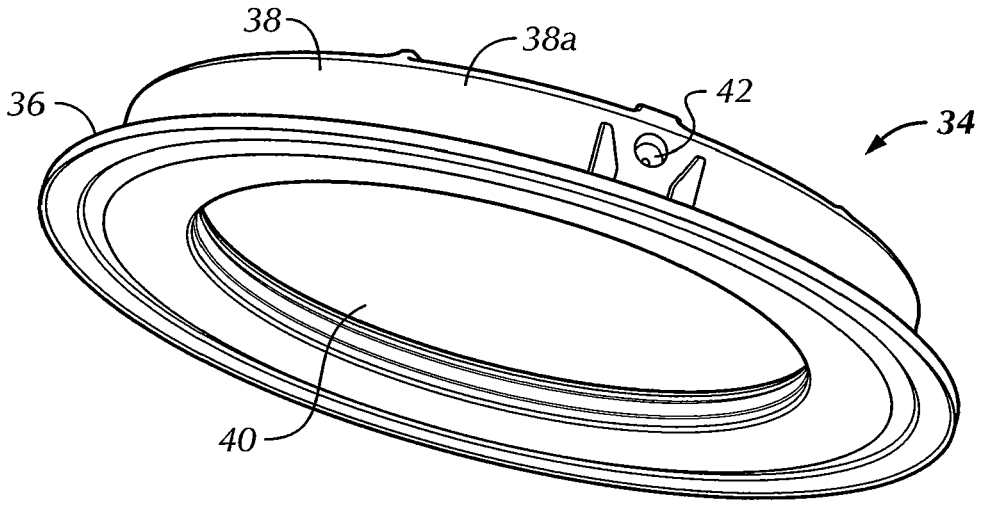
FIG. 11 is a mating side perspective view of a door assembly of the port assembly of FIG. 4.
Figure 12:
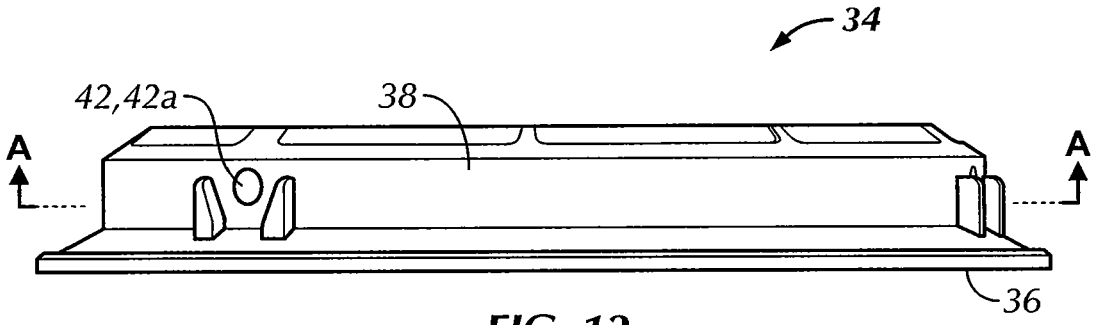
FIG. 12 is a side elevational view of the door assembly of FIG. 11.

Referring to FIGS. 8-10, the flange 12*c* also includes an annular recess 23 that extends axially inwardly from the mating surface 20*a* of the flange 12*c* and a sealing member 26 configured to reside at least partially within the annular recess 23. The annular recess 23 includes recesses 24 and 25 about the radially inward portion of the mating surface 20*a* of the flange 12*c*. Recesses 24 and 25 are configured in a step-wise fashion that steps radially inwardly and downwardly. The sealing member 26, such as a gasket is sized and configured to reside within recesses 24, 25. The sealing member 26 includes corresponding step portions 26*a* and 26*b*. Step portions 26*a* and 26*b* are configured to mate and align with recesses 24 and 25. The sealing member 26 is also configured with a recess 26*c* about the interior of its mating side. The recess 26*c* is configured to receive an annular flange 36 (FIG. 11) of a door assembly 34, as further described in detail below. The sealing member 26 serves to provide a hermetic seal and/or otherwise a barrier between the annular body 12 and the door assembly 34 and between the annular body 12 and the docking port 200. The sealing member 26 can be formed from an elastomer or any other suitable material readily known in the art for forming a gasket such as paper, rubber, silicone, metal, cork, felt, neoprene, nitrile rubber, fiberglass, and/or polymer.

The annular body 12 also includes a radial outer surface 12*a* having an inward taper along an axial direction toward the non-mating side of the annular body 12, as best shown in FIG. 10. The annular body 12 also includes a ridge 32 about its mid-length. The ridge 32 engages with an inwardly extending edge of an inwardly extending ridge 60 on a connector 58 (FIG. 18) to advantageously provide a secure connection of the connector 58 to the annular body 12, as further described in detail below. As the port assembly 10 may be a disposable component, the annular body 12 is preferably made from polycarbonate, but can alternatively be made from any other material suitable for its intended use, such as metals or an alternative rigid polymeric material.

The door assembly 34 is shown in FIGS. 4, 5 and 11-13A. The door assembly 34 is mountable within the annular body 12 and movable between an open position to access an isolated enclosure, such as an enclosure connected to the docking port 200, and a closed position preventing access to the isolated enclosure. The door assembly 34 includes an annular flange 36, a periphery 38, and a wall 40 within the annular flange 36. The wall 40 of the door assembly 34 spans the entire inner diameter of the periphery 38 and is of a substantially planar configuration. The annular flange 36 of the door assembly 34 is a radially outwardly extending flange configured to lay within the recess 26*c* of the sealing member 26. The periphery 38 is of an annular configuration with a recess 42 for receiving the pin 46 of the lock 43, as further described in detail below. The recess 42 is alignable with the thru-hole 13 of the annular body 12 when the door assembly 34 is in the closed position and configured to receive the pin 46 such that a secure mating or engagement of the pin 46 and recess 42 is achieved.

Figure 13:
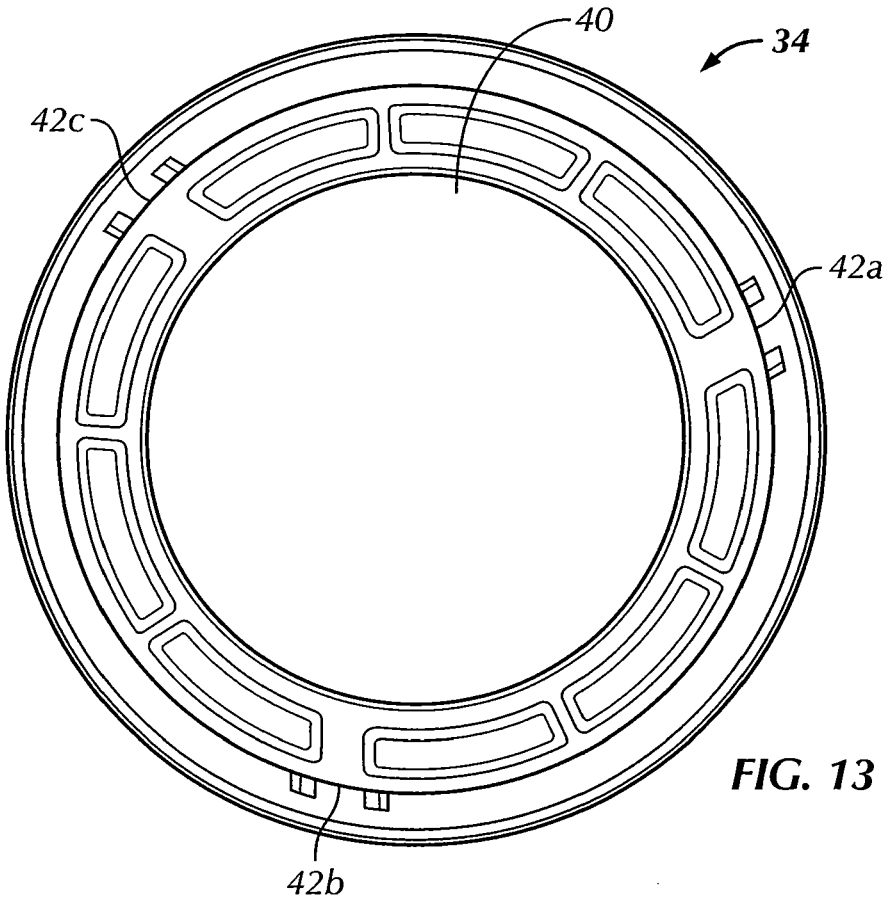
FIG. 13 is a non-mating side elevational view of the door assembly of FIG. 11.
Figure 13A:
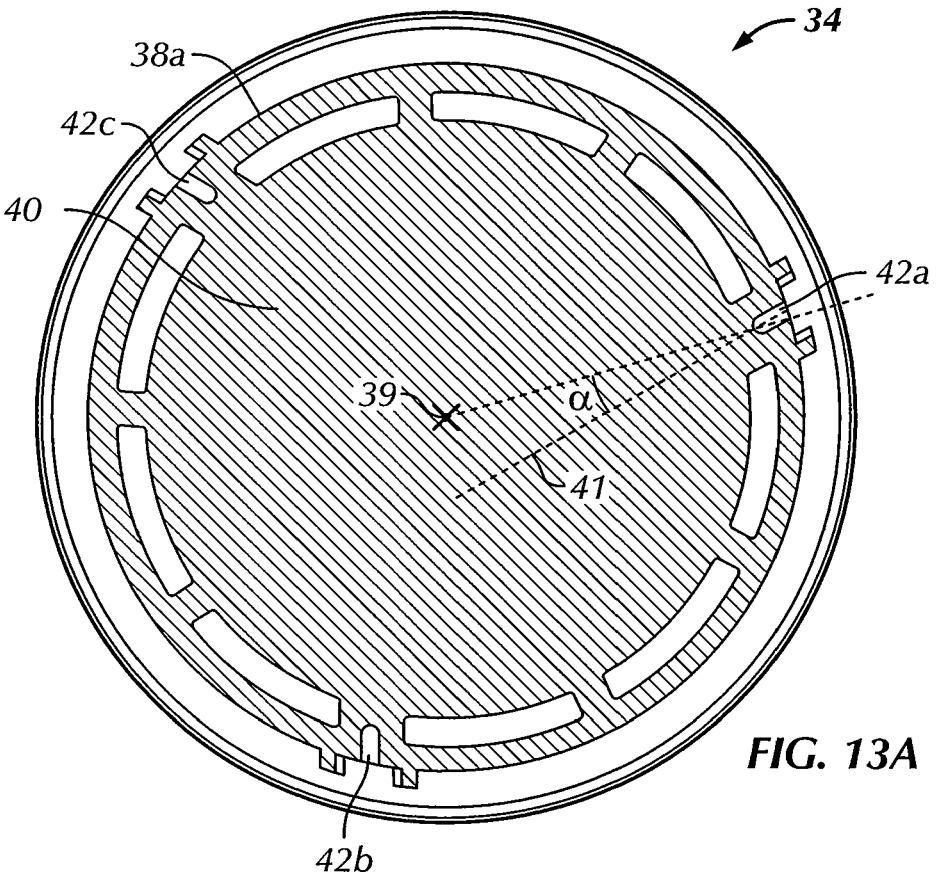
FIG. 13A is a cross-sectional elevational view taken along A-A of the door assembly of FIG. 12.

The recess 42, for example, can be configured as a cylindrical sleeve, a through-hole, a blind hole, or opening. Preferably, the recess 42 is configured to extend at least partially through the periphery 38 of the door assembly 34 (FIG. 13A). The recess 42 originates from an outer surface 38*a* of the periphery 38, as shown in FIG. 13A, and is oriented so a longitudinal axis 41 of the recess 42 is orthogonal to a longitudinal axis of the door assembly 34. The longitudinal axis 41 of the recess 42 is also at an angle $\alpha$, similar to the thru-hole 13, relative to a central longitudinal axis 39 of the door assembly 34. The periphery 38 is preferably configured with a plurality of recesses 42 and more preferably with three recesses 42*a-c* that are circumferentially and equidistantly spaced apart about the periphery 38. Ideally, the number of recesses 42 and positioning of the recesses 42 is matched with the number and positioning of the pins 46 of the locks 43.

Figure 4A:
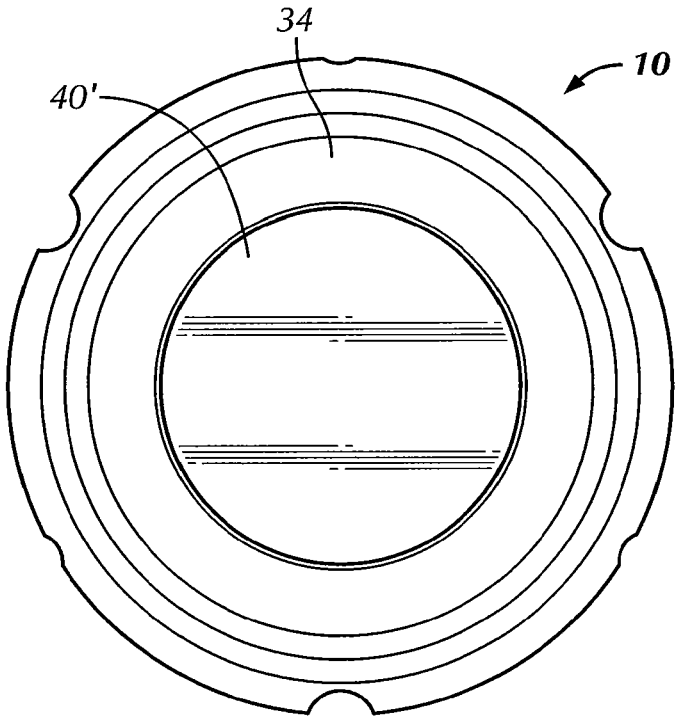
FIG. 4A is a mating side elevational view of the port assembly of FIG. 4 with a metal insert in accordance with another aspect of the present embodiment.

The door assembly 34 is preferably formed from polycarbonate but can alternatively be made from any other material suitable for its intended use, such as a metal or an alternative rigid polymeric material. The wall 40 of the door assembly 34 preferably includes a ferromagnetic material. That is, the wall 40 can be formed from polycarbonate and/or metals, such as metals susceptible to magnetic attraction e.g., steel, iron, and the like. Alternatively, if the wall 40 is formed completely of polycarbonate, the wall 40 can be further configured with a metal insert 40' (FIG. 4A), such as a circular planar ferromagnetic insert. The wall 40 is preferably configured with at least a portion thereof formed out of a ferromagnetic metal such that the alpha-side docking port 200 can attach to the wall 40 by magnetic attraction.

However, the wall 40 can alternatively be configured with a fastening member (not shown), such as an adhesive, a mechanical latch, or any other fastening member suitable for securing the wall 40 to a corresponding door of an alpha-side docking port 200. The door assembly 34 is assembled to the port assembly's annular body 12 and retained therein by the circumferentially spaced locks 43*a-c*, as best shown in FIG. 5.

Referring to FIGS. 5 and 14-17, each lock 43 is operatively connected to a non-mating side of the annular body 12 for securing the door assembly 34 to the annular body 12 and includes a lever 44 and a pin 46. The port assembly 10 preferably includes a plurality of locks 43 and more preferably three locks 43*a-c* that are circumferentially and equidistantly spaced apart about the annular body 12.

Figure 14:
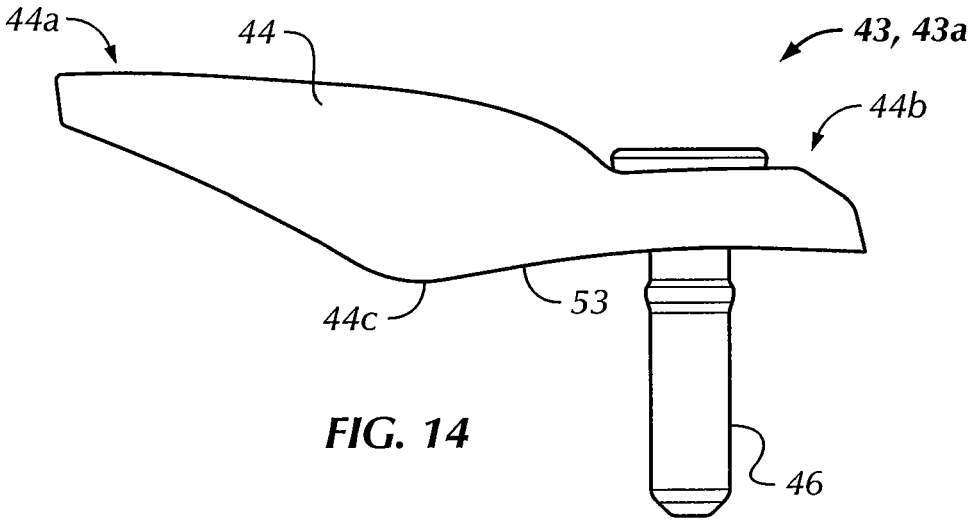
FIG. 14 is an elevational view of a lock of the port assembly of FIG. 5.

The lever 44 is pivotably connected to the annular body 12 about a pivoting member 30, such as a fulcrum 30, as best shown in FIG. 7. The lever 44 includes a first end 44*a*, a second end 44*b* and a middle portion 44*c*. The bottom of the middle portion 44*c* extends further downwardly than the bottoms of the first end and second end 44*a*, 44*b* forming a substantially "V" shaped bottom when viewed as shown in FIG. 14. The extended bottom of the middle portion 44*c* is also operatively connected to the fulcrum 30 by an axis 49 (FIG. 16) that resides within an opening 31 of the pivoting member 30 such that the lever 44 can pivot about the bottom of the middle portion 44*c* on the fulcrum 30. Preferably, the lock 43 is configured to pivot about an axis substantially parallel to a longitudinal axis of the annular body 12. The annular body 12 is also preferably configured with a plurality of fulcrums 30 and more preferably three fulcrums 30*a-c* (only 30*a* and 30*b* shown) that are circumferentially and equidistantly spaced apart about the annular body 12.

Figure 16:
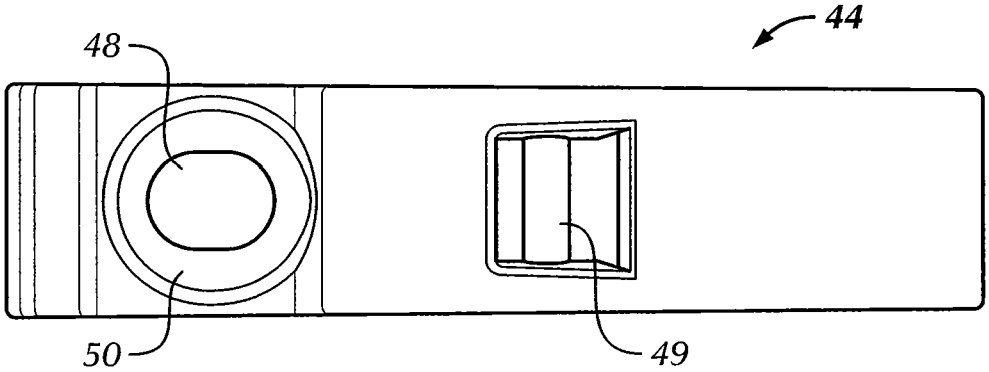
FIG. 16 is a top plan view of a lever of the lock of FIG. 14.
Figure 17:
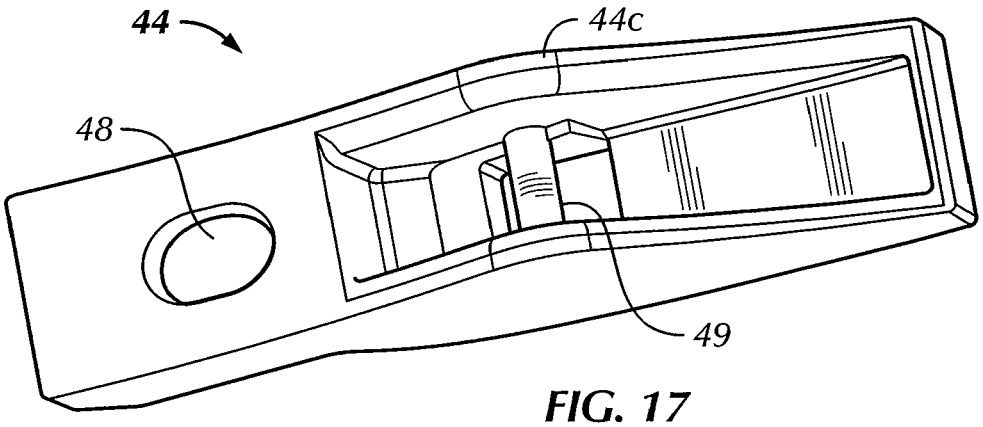
FIG. 17 is a bottom perspective view of the lever of FIG. 16.

As shown in FIG. 16, the top portion of the lever 44 includes a through hole 48, preferably configured as an oblong through hole 48, about its second end 44*b* for connecting to the pin 46. The through hole 48 is configured with a countersink 50 for receiving and connecting to the pin 46. Thus, when connected to the annular body 12, the lever 44 is pivotable to move between a first position with a portion of the pin 46 within the thru-hole 48 and a second position with the pin 46 removably insertable in the recess 42 of the door assembly 34.

As shown in FIG. 14, the bottom portion of the lever 44 includes a first curved portion 53 with a radius that matches the radius of the annular body's outside surface 12*a*. The lever 44 can be formed out of polycarbonate or any other material suitable for its intended use, such as a metal, rigid plastic, composite, or combinations thereof.

Figure 15:
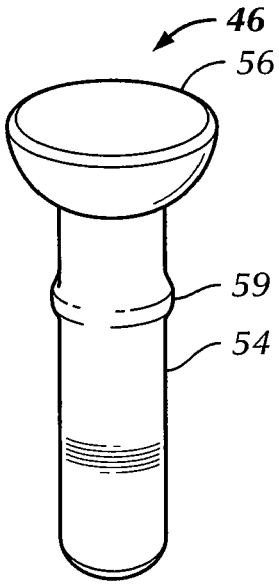
FIG. 15 is a perspective view of a pin of the lock of FIG. 14.

The pin 46 is generally configured as best shown in FIG. 15 with a substantially cylindrical body 54 and a head 56. Preferably, the head 56 is configured with a corresponding tapered profile to mate with the countersink 50 on the lever 44. When in an assembled state, the lock 43 is configured with a portion of the pin 46 within the thru-hole 48 and configured to pivot about the pivoting member 30 to removably insert the pin 46 into the recess 42 of the door assembly 34. In other words, the lock 43 is a multi-use reversible lock that can move between a lock position wherein the door assembly 34 is locked to the annular body 12 and a release position wherein the door assembly 34 is releasable from the annular body 12. The pin 46 is preferably formed out of stainless steel, but can alternatively be formed out of any other material suitable for its intended use.

Figure 15A:
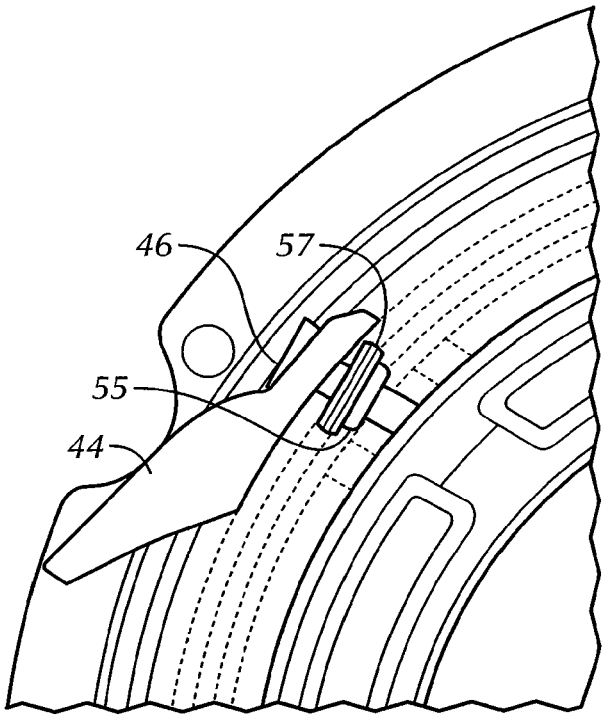
FIG. 15A is an enlarged, elevational view of a lock in the locked position of the port assembly of FIG. 5 in accordance with another aspect of the present embodiment with the annular body illustrated in phantom.
Figure 15B:
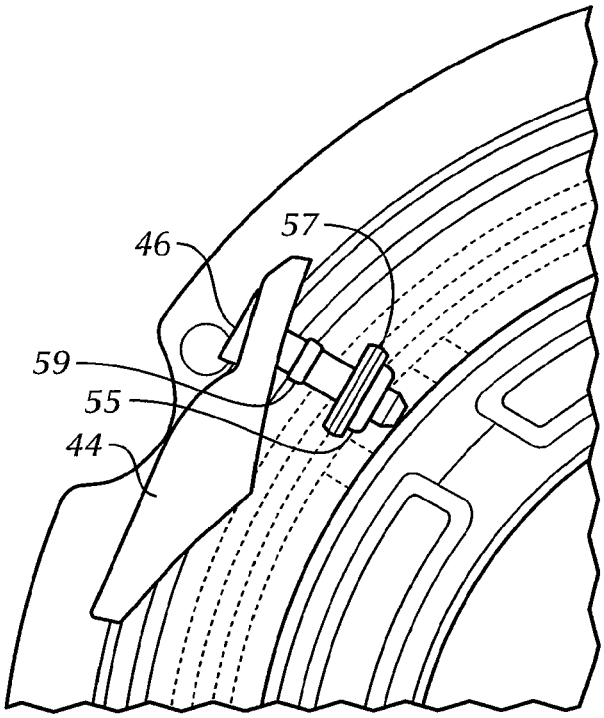
FIG. 15B is an elevational view of the lock of FIG. 15A in the release position with the annular body illustrated in phantom.

The pin 46 can optionally be configured with a resilient member 55 that circumscribes the pin 46, as shown in FIG. 15A. The resilient member 55 is preferably an O-ring 55. The pin 46 can also include a circumambient member 57, such as a washer 57, that is assembled to the pin 46 superior to the resilient member 55. The circumambient member 57 and resilient member 55 are configured to reside within the double counterbore 15 of the thru-hole 13 and advantageously facilitates securing the pin 46 to the lever 44 while providing a necessary drag force for the pin 46. An additional ridge 59 can also optionally be added to the pin 46 about a proximal end of the pin 46 to further facilitate retention of the pin on the lever 44. FIG. 15A illustrates the lock 43 in the locked position, while FIG. 15B illustrates the lock in the released position.

Referring back to FIG. 5, the door assembly 34 is assembled to the annular body 12 while the locks 43*a-c* are in the open position, as shown for lock 43*c*. In the assembled state, the recesses 42*a-c* are aligned with the thru-holes 13*a-c* and locks 43*a-c*, respectively, such that the pins 46*a-c* can engage the recesses 42*a-c*, as shown for pins 46*a* and 46*c*. The locks 43 are moved from the locked position to the unlocked/released position by cam assemblies 202 (FIG. 3) on the alpha-side docking port 200 that function to pivot the levers 44 about the pivoting member 30. The locks 43 are configured such that the cam assemblies 202 are situated on the top side of the levers 44 to cam the levers 44 to the locked and unlocked positions. The structure, function, and operation regarding such cam assemblies capable of functioning with the locks 43 are known in art and a detailed description of them is not necessary for a complete understanding of the present invention. However, such structure and operation are disclosed in the above-referenced '207 patent.

Figure 18:
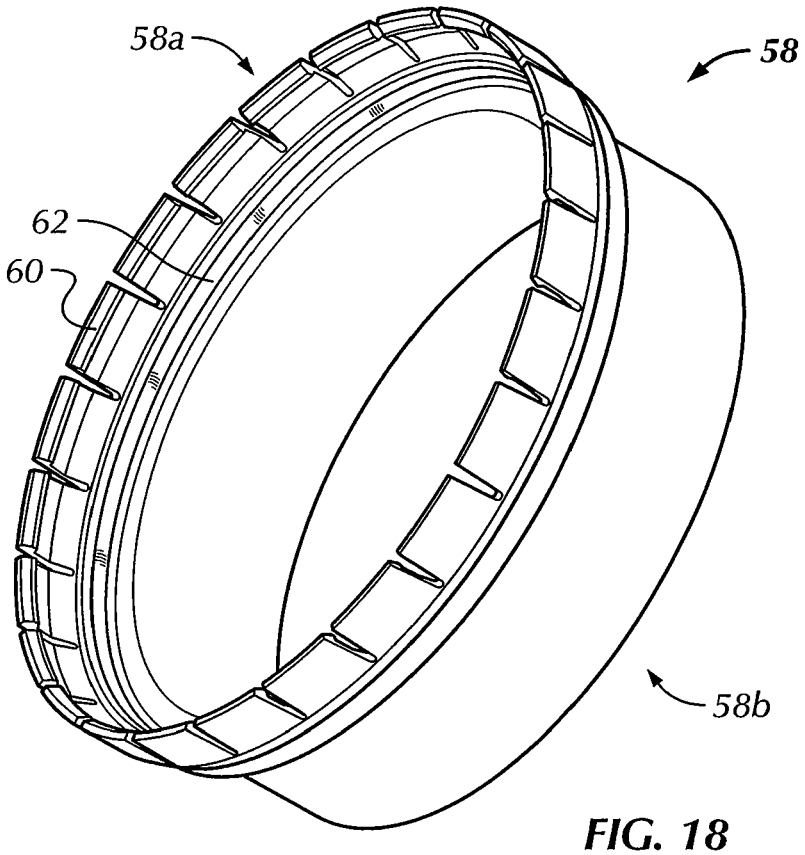
FIG. 18 is a mating side perspective view of a connector of the port assembly of FIG. 4.
Figure 19:
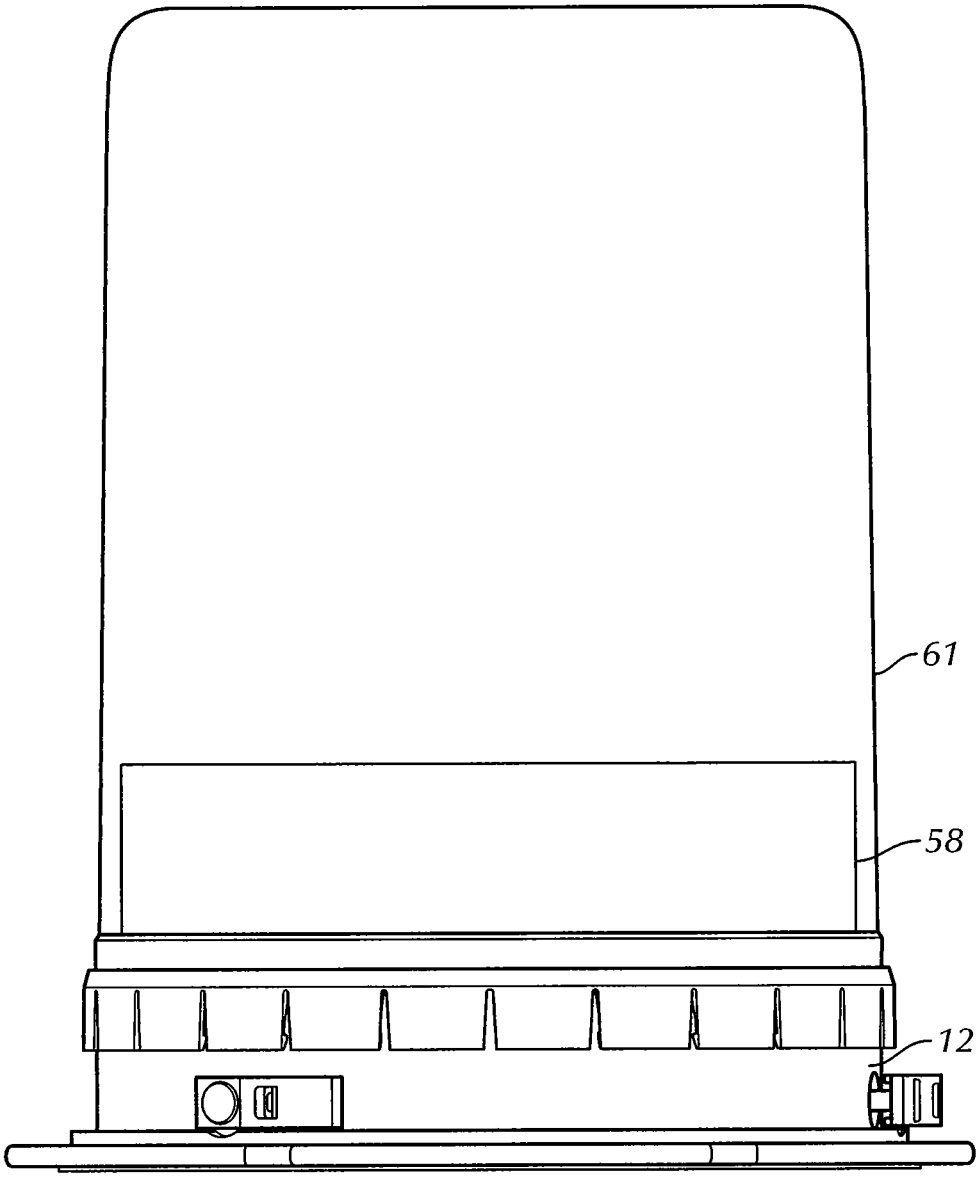
FIG. 19 is a side view of the port assembly of FIG. 4 assembled to a container.

A connector 58 in accordance with another aspect of the present invention is shown in FIGS. 18-19. The connector 58 serves to connect the overall port assembly 10 to a container 61, such as a plastic bag 61 or any other isolated enclosure (not shown). That is, the container 61 is connectable to connector 58 about its non-mating side 58*b*. As shown in FIGS. 18 and 19, the mating-side 58*a* of the connector 58 is configured to mate with the non-mating side of the annular body 12. The connector 58 also includes a ridge 60 having a radially inwardly extending edge configured to snap-fit over the ridge 32 situated on the outer surface 12*a* of the annular body 12. In particular, the radially inwardly extending edge of the ridge 60 engages a radially outwardly extending ledge on the ridge 32. The ridge 60 also includes a plurality of slits partially segmenting the ridge 60 to allow the ridge 60 to expand and snap-fit over the ridge 32.

The connector 58 can be formed out of high density polyethylene, but can alternatively be formed out of any other material suitable for its intended use. For example, the connector 58 can be formed out of the same material as that of the container 61 to which it is connected to. The connection between the connector 58 and the container 61 can be formed by welding or the like.

Referring to FIG. 18, the port assembly 10 also includes an O-ring 62 seated in between the annular body 12 and the connector 58 to provide a hermetic seal therebetween. The O-ring 62 is located about the non-mating side of the annular body 12 about a radially inwardly extending flange 63 and circumscribes the annular body 12. The O-ring 62 can be formed out of any resilient material, such as a polymeric material including an elastomer.

Figure 1:
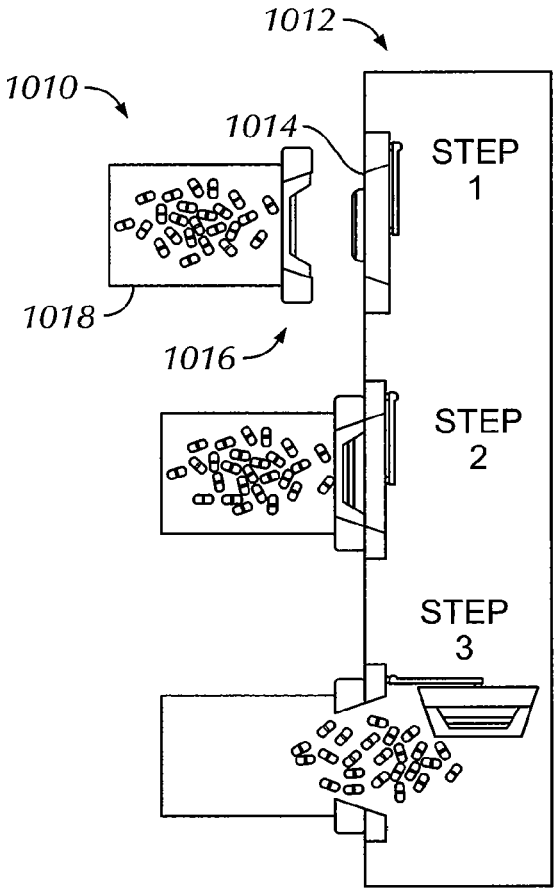
FIG. 1 (Prior Art)
FIG. 1 is a diagrammatic illustration sequencing the operation of a transfer of the contents of one isolated enclosure to another isolated enclosure by a conventional means.

In operation, the port assembly 10 is brought into engagement with the alpha-side docking port 200, as illustrated in FIG. 1. In engaging the port assembly 10 to the alpha-side docking port 200, the cutouts 22*a-c* are aligned with respective cam assemblies 202 situated to engage the top surface of the levers 44. Engagement of the port assembly 10 to the alpha-side docking port 200 also initiates engagement/connection (or interlocking) of the door assembly 34 to the alpha-side docking port door (not shown) by conventional means to form an enclosure isolating the outside surfaces of the respective doors. Thereafter, operation of the cam assemblies 202 causes the door locks 43*a-c* to pivot and move the pins 46*a-c* from the locked position to the unlocked/released position. Afterwards, a user can remove the interlocked doors, similar to that shown in FIG. 1, step 3, to allow access through the port assembly 10 and alpha-side docking port 200 for the passage of materials therethrough.

To then reseal the port assembly 10 and alpha-side docking port 200, a user reinserts the interlocked doors into the docking port 200. Thereafter, the cam assemblies 202 can then be moved in the opposite direction to cause the locks 43*a-c* to pivot and move the pins 46*a-c* from the unlocked position to the locked position, thereby locking the door assembly 34 to the port assembly 10. Disengagement of the door assembly 34 from the door of the alpha-side docking port 200 can then be effectuated, thereby allowing for the separation of the port assembly 10 from the alpha-side docking port 200.

In sum, the port assembly 10 of the present invention provides for a disposable, easy to use, and reusable port assembly for the transfer of materials within one isolated enclosure to another isolated enclosure without exposing the contents of the isolated enclosures to the external environment. As can be seen from the foregoing, the present embodiments of the invention advantageously provides for a port assembly compatible with conventional port assemblies that allows for the transfer of material therethrough. The present embodiments further provide for a port assembly that can be reused multiple times, thus providing for a more versatile and economically useful port assembly.

It will be appreciated by those skilled in the art that changes could be made to the embodiments described above without departing from the broad inventive concept thereof. It is to be understood, therefore, that the present invention is not limited to the particular embodiments disclosed, but it is intended to cover modifications within the spirit and scope of the present invention as set forth in the appended claims.

We claim:

1. A barrier isolator port assembly comprising:

an annular body configured to engage a docking port of an isolated enclosure, the annular body having an outside surface with an annular-body radius and including a thru-hole having a longitudinal axis at an angle relative to a radial direction of the angular body;

a door assembly mountable within the annular body and movable between an open position to access the enclosure and a closed position preventing access to the enclosure, the door assembly including a periphery having a recess alignable with the thru-hole when the door assembly is in the closed position; and a lock operatively connected to the annular body, the lock including:

a lever having first and second ends and a middle portion between the first and second ends, the middle portion being pivotably connected to the annular body about a pivoting member, a bottom portion of the lever having a curved portion with a lever-radius substantially the same as the annular-body radius, and a pin connected to the second end, the lever being pivotable to move between a first position with a portion of the pin within the thru-hole and a second position with the pin removably inserted in the recess of the door assembly.

2. The barrier isolator port assembly of claim 1, wherein the annular body comprises three thru-holes, the periphery of the door assembly includes three recesses, and the port assembly includes three locks.

3. The barrier isolator port assembly of claim 1, wherein the annular body comprises a plurality of thru-holes, the periphery of the door assembly includes a plurality of recesses, and the port assembly includes a plurality of locks.

4. The barrier isolator port assembly of claim 3, wherein each of the plurality of thru-holes, the plurality of recesses, and the plurality of locks are circumferentially and equidistantly spaced apart.

5. The barrier isolator port assembly of claim 1, wherein the lock is operatively connected to a non-mating side of the annular body.

6. The barrier isolator port assembly of claim 5, wherein the lock pivots about an axis substantially parallel to a longitudinal axis of the annular body.

7. The barrier isolator port assembly of claim 1, wherein the door assembly further includes a wall within the periphery comprising a ferromagnetic material.

8. The barrier isolator port assembly of claim 1, wherein the annular body further comprises:

an outer surface; and an inner surface, wherein the thru-hole extends from the outer surface to the inner surface.

9. The barrier isolator port assembly of claim 8, wherein the thru-hole of the annular body is a cylindrical thru-hole having a longitudinal axis generally orthogonal to a longitudinal axis of the annular body, and wherein the longitudinal axis of the thru-hole is at an angle relative to a radial direction of the annular body.

10. The barrier isolator port assembly of claim 9, wherein the angle is about 5 to 20 degrees.

11. The barrier isolator port assembly of claim 1, wherein the annular body further comprises:

a radially outwardly extending flange about a mating side of the annular body configured to engage the docking port, the flange including:

a mating surface; and a non-mating surface.

12. The barrier isolator port assembly of claim 11, wherein the flange of the annular body further comprises a seal to hermetically seal the annular body to the docking port.

13. The barrier isolator port assembly of claim 11, wherein the flange of the annular body further comprises:

an annular recess extending from the mating surface; and a sealing member configured to reside within the annular recess.

14. The barrier isolator port assembly of claim 1, further comprising a connector connectable to a non-mating side of the annular body.

15. The barrier isolator port assembly of claim 14, further comprising a container connectable to the connector.

16. The barrier isolator port assembly of claim 1, further comprising a resilient member circumscribing the pin.

17. The barrier isolator port assembly of claim 16, further comprising a annular member configured about the pin and above to the resilient member.

18. The barrier isolator port assembly of claim 1, wherein the recess of the door assembly extends partially through the body of the door assembly.

19. The barrier isolator port assembly of claim 1, wherein the second end of the lever has a thru-hole and the pin is pivotable within the thru-hole.

20. The barrier isolator port assembly of claim 1, wherein the lock is unlockable by a cam assembly of an alpha-side docking port when the barrier isolator port assembly is engaged with the alpha-side docking port.

* * * * *